US012234060B2

(12) United States Patent
Plourde

(10) Patent No.: US 12,234,060 B2
(45) Date of Patent: Feb. 25, 2025

(54) CHILD-RESISTANT RECLOSABLE BAGS

(71) Applicant: Illinois Tool Works Inc., Glenview, IL (US)

(72) Inventor: Eric Plourde, Frankfort, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 17/885,673

(22) Filed: Aug. 11, 2022

(65) Prior Publication Data

US 2023/0089271 A1 Mar. 23, 2023

Related U.S. Application Data

(60) Provisional application No. 63/246,375, filed on Sep. 21, 2021.

(51) Int. Cl.
*B65D 33/25* (2006.01)

(52) U.S. Cl.
CPC ..... *B65D 33/2541* (2013.01); *B65D 2215/04* (2013.01)

(58) Field of Classification Search
CPC ..... B65D 33/2541; B65D 2215/04
USPC ..... 383/63
See application file for complete search history.

(56) References Cited

U.S. PATENT DOCUMENTS

| | | | | |
|---|---|---|---|---|
| 9,284,097 | B2 | 3/2016 | Heckman | |
| 9,957,087 | B2 | 5/2018 | Takigawa | |
| 10,118,737 | B2 | 11/2018 | Septien Rojas | |
| 10,287,063 | B2 | 5/2019 | Septien Rojas | |
| 10,766,669 | B2 | 9/2020 | Septien Rojas | |
| 11,866,228 | B2 * | 1/2024 | Plourde | B65B 69/0008 |
| 2006/0008186 | A1 * | 1/2006 | Kusz | B65D 33/2541 383/65 |
| 2014/0270585 | A1 * | 9/2014 | Heckman | B65D 33/2508 493/210 |

FOREIGN PATENT DOCUMENTS

| | | |
|---|---|---|
| CN | 213169335 | 5/2021 |
| WO | 2019/016553 | 1/2019 |
| WO | WO-2023210362 A1 * | 11/2023 |

OTHER PUBLICATIONS

Notification and Transmittal of the International Search Report and the Written Opinion of the International Searchign Authority, or the Declaration for PCT/US2022/040142, dated Jan. 23, 2023.
International Preliminary Report on Patentability for PCT/US2022/040142 dated Apr. 4, 2024 (11 pages).

* cited by examiner

*Primary Examiner* — Jes F Pascua
(74) *Attorney, Agent, or Firm* — Christopher R. Carroll; The Small Patent Law Group LLC

(57) ABSTRACT

A child-resistant reclosable bag includes a container configured to retain one or more items, and a zipper coupled to the container. The zipper includes one or more primary seals, and one or more secondary seals at one or more defined locations. The one or more secondary seals at the one or more defined locations provide one or more areas to be engaged to peel open the container.

21 Claims, 3 Drawing Sheets

CHILD-RESISTANT RECLOSABLE BAGS

CROSS-REFERENCE TO RELATED APPLICATIONS

This application claims priority to U.S. Provisional Application No. 63/246,375, filed Sep. 21, 2021, which is hereby incorporated by reference in its entirety.

BACKGROUND

Technical Field

The subject matter described herein relates to child-resistant reclosable bags.

Discussion of Art

Child-resistant bags are used to hold items, such as medicinal capsules, detergent capsules, *cannabis* products, and/or the like. Such items may be attractive, but harmful, to a child.

Certain packages include plastic lids, which, in order to be removed from a glass or plastic container, are squeezed or pushed in various ways which may not be apparent to a child, and/or beyond the strength capabilities of the child. However, such containers are complicated to manufacture and add a considerable expense to a finished product. Additionally, such containers may be heavy and bulky, which adds to a cost of transportation. Moreover, the weight and bulk adds to a recycling burden of these products.

A known child-resistant reclosable bag includes a seal above locking elements of a two-piece zipper on one zipper half and only below the locking elements on the other zipper half. As such, the bag can be put into a shear mode that is extremely difficult to open when simply pulling the top of the flexible package open as would be done for a typical reclosable flexible package, as described in U.S. Pat. No. 10,118,737, entitled "Child-Resistant Reclosable Bags" (the "737 Patent"), which is hereby incorporated by reference in its entirety. U.S. Pat. No. 10,287,063, entitled "Child-Resistant Reclosable Bags," and U.S. Pat. No. 10,766,669, entitled "Four-Flange Child-Resistant Zipper and Bag" provide other examples. Various devices for opening such packages have been developed. For example, the 737 Patent describes a complete, but unattached upper flange. As another example, small, graspable tabs are engaged in order to open the closure.

BRIEF DESCRIPTION

A need exists for a child-resistant bag that does not require graspable tabs for opening, which can be difficult to manipulate and operate, and also provide scrap, such as during a manufacturing operation. Further, a need exists for an opening feature on a child-resistant bag which can be incorporated during bag fabrication, thereby allowing registration with the bag, in contrast to a random location of tabs.

With those needs in mind, certain embodiments of the present disclosure provide a child-resistant reclosable bag, including a container configured to retain one or more items, and a zipper coupled to the container. The zipper includes one or more primary seals, and one or more secondary seals at one or more defined locations. The one or more secondary seals at the one or more defined locations provide one or more areas to be engaged to peel open the container.

In at least one example, the zipper further includes a first upper flange on a first face of the container. The one or more secondary seals extend from the first upper flange. A first lower flange is on the first face of the container. A first primary seal extends from the first lower flange. A second upper flange is on a second face of the container. A second primary seal extends from the second upper flange.

In at least one embodiment, wherein the one or more primary seals extend along an entire width of the container, and the one or more secondary seals extend along less than the entire width of the container.

In at least one example, the one or more secondary seals are proximate to a side of the bag.

In at least one embodiment, the one or more secondary seals are less than half a length of the one or more primary seals. For example, the one or more secondary seals are between 5-10% of a length of the one or more primary seals.

In at least one example, the one or more secondary seals are at a height that is the same or greater than a height of locking elements of the zipper.

The one or more secondary seals can be one or more of color-coded, identified with text, or identified with a tactile feature.

The child-resistant reclosable bag can also include indicia for instructions for opening.

In at least one embodiment, wherein the child-resistant reclosable bag is devoid of zipper tabs.

In at least one example, the one or more secondary seals are integrally formed with the container (as shown in FIG. 6).

Certain embodiments of the present disclosure provide a method of forming a child-resistant reclosable bag. The method includes providing one or more primary seals on a zipper: providing one or more secondary seals at one or more defined locations on the zipper, wherein the one or more secondary seals at the one or more defined locations provide one or more areas to be engaged to peel open a container; and coupling the zipper to the container configured to retain one or more items.

In at least one example, the method also includes identifying the one or more secondary seals with one or more of color-coding, text, or a tactile feature.

In at least one example, the method also includes providing indicia for instructions for opening on the container.

In at least one example, the method also includes integrally forming the one or more secondary seals with the container.

BRIEF DESCRIPTION OF THE DRAWINGS

The inventive subject matter may be understood from reading the following description of non-limiting embodiments, with reference to the attached drawings, wherein below.

DETAILED DESCRIPTION

Certain embodiments of the present disclosure provide a child-resistant reclosable bag that can be devoid of cut zipper tabs. Zipper tabs can be difficult to operate, and typically result in scrap during manufacturing. Moreover, certain embodiments of the present disclosure provide a child-resistant reclosable bag that allows for an opening feature and location to be incorporated during bag fabrication, thereby allowing registration with the pouch, in contrast to a random location of tabs.

Figure 1:
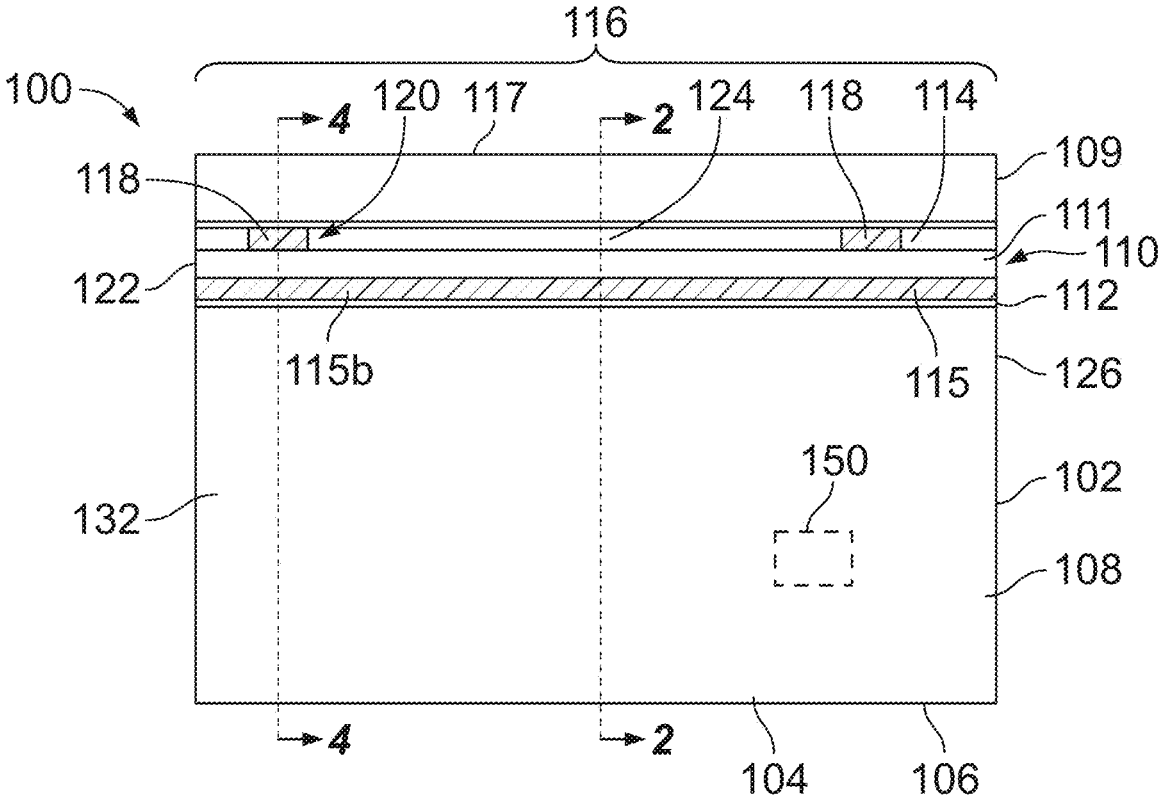
FIG. 1 illustrates a lateral view of a child-resistant reclosable bag, according to an embodiment of the present disclosure.

FIG. 1 illustrates a lateral view of a child-resistant reclosable bag 100, according to an embodiment of the present disclosure. The bag 100 includes a container 102, such as a flexible pouch, package, bag, or the like, configured to hold one or more items (not shown). In at least one embodiment, the bag 100 is formed of one or more flexible and resilient polymers.

The container 102 includes a sealed base 104 at a bottom end 106, flexible walls 108 extending upwardly from the base 104, and an openable top end 109. A zipper 110 is coupled to the container 102 and is disposed proximate the top end 109. The zipper 110 is configured to allow the bag 100 to be selectively opened and closed. The zipper 110 includes opposed locking elements 111 on either face of the bag 100 that are configured to selectively mate with one another, as is known.

The zipper 110 further includes a lower flange 112 below the locking elements 111, and an upper flange 114 above the locking elements 111. A primary seal 115 (such as the primary seal 115*b*) is disposed on the lower flange 112. The primary seal 115 extends across a width 116 of the bag 100. A secondary seal 118 is disposed on the upper flange 114. The secondary seal 118 is separate and distinct from the primary seal 115. As shown, the primary seal 115 and the secondary seal 118 can be on one face, such as the face 132 of the bag 100. In at least one embodiment, the primary seal 115 sealingly couples to the face 132 from the lower flange 112, the secondary seal 118 sealingly couples to the face 132 from the upper flange 114, and another primary seal couples to an opposite face (such as the face 130 shown in FIGS. 2-4) from an upper flange.

The secondary seal 118 is located at a defined area 120 of the upper flange 114. The secondary seal 118 extends along only a portion of the width 116. For example, the secondary seal 118 is located proximate to a side 122 of the bag 100. As shown, the secondary seal 118 is offset from the side 122 toward a middle 124 of the upper flange 114. In at least one embodiment, the secondary seal 118 does not extend to the middle 124 of the upper flange 114. Instead, the secondary seal 118 is closer to the side 122 of the bag 100 than the middle 124 of the upper flange 114.

In at least one embodiment, the secondary seal 118 is substantially shorter than the primary seal 115. For example, the secondary seal 118 can be less than half the length of the primary seal 115. In at least one embodiment, the secondary seal 118 is less than 25% of the length of the primary seal 115. For example, the secondary seal 118 can be between 5-10% the length of the primary seal 115. By making the secondary seal 118 substantially shorter than the primary seal 115, and locating it away from the side 122 and the middle 124, the likelihood of a child engaging the secondary seal 115 is reduced.

As shown, the secondary seal 118 is proximate to the side 122. Optionally, the secondary seal 118 can be located proximate to the side 126, which is opposite from the side 122.

In at least one embodiment, the bag 100 includes only one secondary seal 118 at a location that a child may not intuitively grasp. In at least one other embodiment, the bag 100 includes at least one other secondary seal 118. For example, the bag 100 can include a secondary seal 118 proximate to the side 122, and a secondary seal 118 at a defined area 120 proximate to the side 126. As another example, the bag 100 can include three or more secondary seals.

Figure 2:
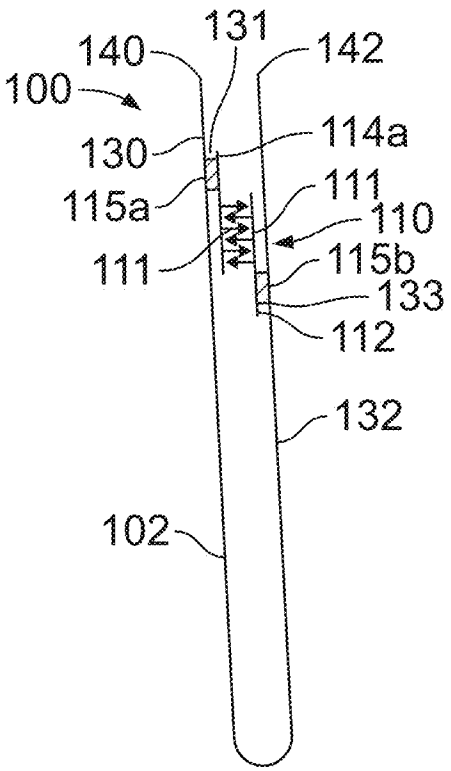
FIG. 2 illustrates a cross-sectional view of the child-resistant reclosable bag of FIG. 1 through line 2-2.

FIG. 2 illustrates a cross-sectional view of the child-resistant reclosable bag 100 of FIG. 1 through line 2-2. In at least one embodiment, the zipper 110 includes the upper flange 114*a* having a first primary seal 115*a* extending along a first face 130 of the container 102, and the lower flange 112 having a second primary seal 115*b* extending along a second face 132, opposite from the first face 130, of the container 102. It is to be understood that the first face 130 may be considered the second face, and the second face 132 may be considered the first face. The terms first and second, for example, are merely to indicate numbers of faces, for example, and are not to limit the identity of the faces, for example.

Figure 3:
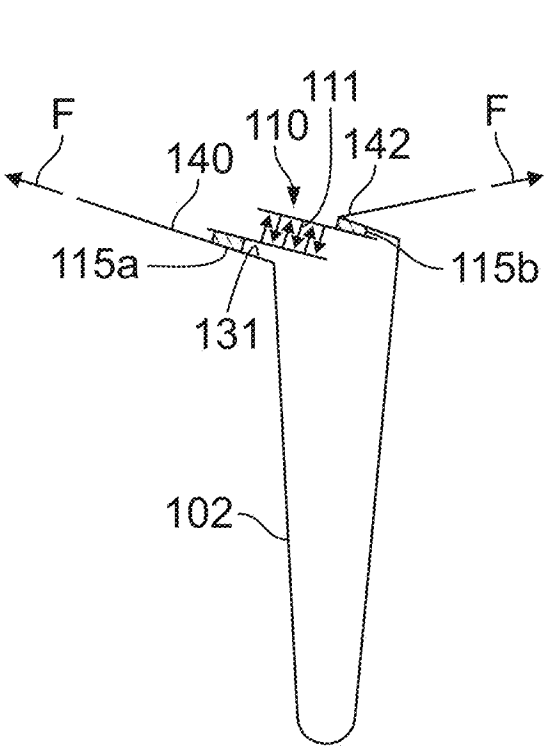
FIG. 3 illustrates a cross-sectional view of the child-resistant reclosable bag of FIG. 2 having opposed forces applied thereto.

FIG. 3 illustrates a cross-sectional view of the child-resistant reclosable bag 100 of FIG. 2 having opposed forces F applied thereto. Referring to FIGS. 2 and 3, the upper flange 114*a* can be coupled to just the first face 130 of the container 102, and the lower flange 112 can be coupled to just the second face 132 of the container 102. Optionally, the zipper 110 can include an upper flange and a lower flange coupled to both the first face 130 and the second face 132. As shown, the seal 115*a* extends away from the upper flange 114*a* and sealingly engages an inner surface 131 of the container 102. Similarly, the seal 115*b* extends away from the lower flange 112 and sealingly engages an inner surface 133 of the container 102. As shown in FIG. 3, in particular, when the upper ends 140 and 142 of the opposite faces 130 and 132, respectively, are grasped and pulled with opposed forces F, the bag 100 is forced into a shear mode, making it extremely difficult to pull the closure halves apart.

Figure 4:
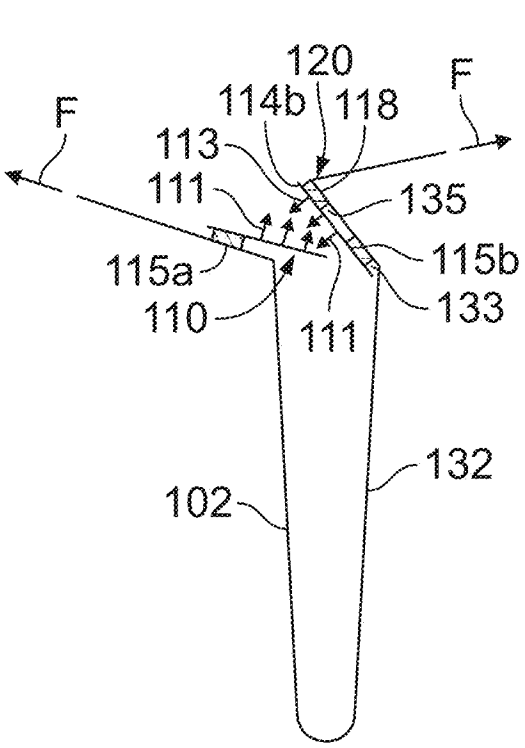
FIG. 4 illustrates a cross-sectional view of the child-resistant reclosable bag of FIG. 1 having opposed forces applied thereto.

FIG. 4 illustrates a cross-sectional view of the child-resistant reclosable bag 100 of FIG. 1 having opposed forces F applied thereto. As shown in FIG. 4, the secondary seal 118 extends away from the upper flange 114*b* and sealingly engages an inner surface 135 of the container 102 above the locking elements 111 of the zipper 110. The secondary seal 118 can be on the second face 132, or optionally the first face 130. In at least one other embodiment, a secondary seal 118 can be on the first face 130, and another secondary seal 118 can be on the second face 132.

In at least one embodiment, the secondary seal 118 is at a height on the container 102 that is at least the same as a top 113 of the locking elements 111. The height is measured from the bottom end 106 to a top edge 117. An item has increased height the closer it is to the top edge 117. In at least one embodiment, the secondary seal 118 can be at the same height as the locking elements 111. In at least one other embodiment, the secondary seal 118 is above the locking elements 111.

When force F is applied to the top of the container 102 at the defined area 120 of the secondary seal 118, the container 102 is put into a typical peel mode, and is able to be opened in the area 120. Once the opening of the closure is initiated in the area 120, the force F can easily be propagated across the entire width of the container 102, thereby allowing the container 102 to be opened.

As such, in order to open the container 102, an individual first grasps the area 120 of the secondary seal 118. Force F is then applied at the area 120, which then allows the container to be opened.

In at least one embodiment, the secondary seal 118 can be coded to indicate its identity. For example, the secondary seal 118 can be color coded. As another example, the secondary seal 118 can be identified with text. As another example, the secondary seal 118 can be identified through a tactile feature, such as a dimple, bump, protuberance, or the like.

Referring again to FIG. 1, the bag 100 can include indicia 150 for instructions on opening. For example, the indicia 150 can be printed, adhered, or the like to a face 130 and/or 132 of the container 102. The indicia 150 can be or include text, graphics, or the like that provide instructions for opening the bag 100 (that is, applying the force F at the defined area 120 first).

As described herein, the bag 100 takes advantage of well understood shear versus peel forces on a two piece zipper enclosure. The bag 100 greatly reduces necessary force applied at an initial opening area (that is, the area 120 of the secondary seal 118) in contrast to certain known child-resistant reclosable bags.

Figure 6:
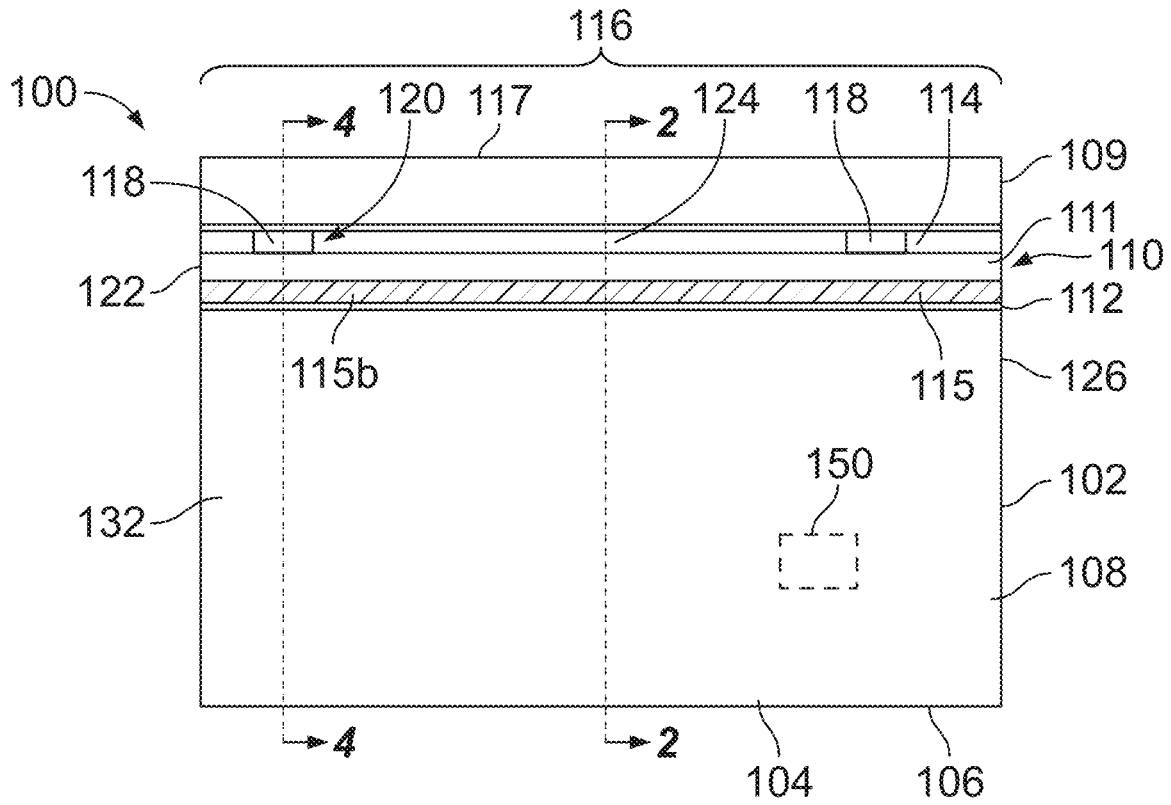
FIG. 6 illustrates a lateral view of a child-resistant reclosable bag, according to an embodiment of the present disclosure.

The secondary seal 118 at the area 120 provides the location for initial engagement of force to open the bag 100. The secondary seal 118 identifies the location to be first engaged to peel open the bag 100 and disengage the opposed locking elements 111 of the zipper 110 from one another. There is no need for cutting tabs to provide such a location. As such, scrap during manufacturing is reduced. The secondary seal 118 can be formed on the container 102 as the container 102 is formed, and easily registered with the container 102. That is, the secondary seal 118 can be integrally formed with the container 102 as the container 102 is being formed (as shown in FIG. 6).

Figure 5:
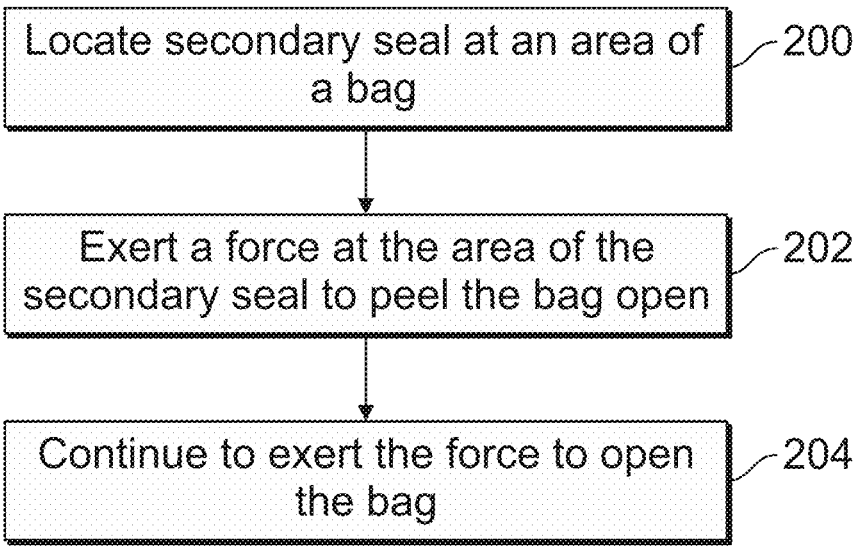
FIG. 5 illustrates a flow chart of a method of opening a child-resistant bag, according to an embodiment of the present disclosure.

FIG. 5 illustrates a flow chart of a method of opening a child-resistant bag, according to an embodiment of the present disclosure. Referring to FIGS. 1-5, the method include locating the secondary seal 118 at the defined area 120 of the bag 100. Next, at 202, a force F is exerted at the area 120 of the secondary seal 118 to peel open the bag 100. At 204, the force F continues to be exerted along a width 116 of the bag 100 to open the bag 100.

Figure 7:
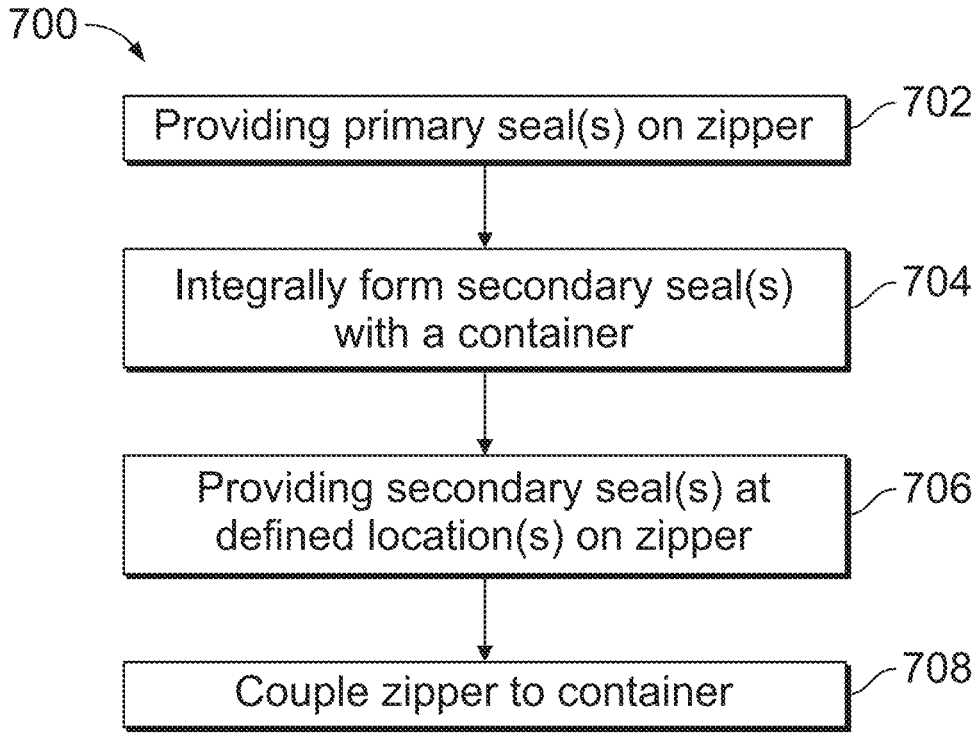
FIG. 7 illustrates a flow chart of a method of forming a child-resistant reclosable bag, according to an embodiment of the present disclosure.

FIG. 7 illustrates a flow chart of a method 700 of forming a child-resistant reclosable bag, according to an embodiment of the present disclosure. The method 700 includes providing one or more primary seals on a zipper (at 702); integrally forming the one or more secondary seals with a container (at 704); providing one or more secondary seals at one or more defined locations on the zipper (at 706), where the one or more secondary seals at the one or more defined locations provide one or more areas to be engaged to peel open a container; and coupling the zipper to the container configured to retain one or more items (at 708).

Further, the disclosure comprises examples according to the following clauses:

Clause 1. A child-resistant reclosable bag, comprising:
- a container configured to retain one or more items; and
- a zipper coupled to the container, wherein the zipper comprises:
  - one or more primary seals; and
  - one or more secondary seals at one or more defined locations, wherein the one or more secondary seals at the one or more defined locations provide one or more areas to be engaged to peel open the container.

Clause 2. The child-resistant reclosable bag of Clause 1, wherein the zipper further comprises:
- a first upper flange on a first face of the container, wherein the one or more secondary seals extend from the first upper flange;
- a first lower flange on the first face of the container, wherein a first primary seal extends from the first lower flange; and
- a second upper flange on a second face of the container, wherein a second primary seal extends from the second upper flange.

Clause 3. The child-resistant reclosable bag of Clauses 1 or 2, wherein the one or more primary seals extend along an entire width of the container, and wherein the one or more secondary seals extend along less than the entire width of the container.

Clause 4. The child-resistant reclosable bag of any of Clauses 1-3, wherein the one or more secondary seals are proximate to a side of the bag.

Clause 5. The child-resistant reclosable bag of any of Clauses 1-4, wherein the one or more secondary seals are less than half a length of the one or more primary seals.

Clause 6. The child-resistant reclosable bag of any of Clauses 1-5, wherein the one or more secondary seals are between 5-10% of a length of the one or more primary seals.

Clause 7. The child-resistant reclosable bag of any of Clauses 1-6, wherein the one or more secondary seals are at a height that is the same or greater than a height of locking elements of the zipper.

Clause 8. The child-resistant reclosable bag of any of Clauses 1-7, wherein the one or more secondary seals are one or more of color-coded, identified with text, or identified with a tactile feature.

Clause 9. The child-resistant reclosable bag of any of Clauses 1-8, further comprising indicia for instructions for opening.

Clause 10. The child-resistant reclosable bag of any of Clauses 1-9, wherein the child-resistant reclosable bag is devoid of zipper tabs.

Clause 11. The child-resistant reclosable bag of any of Clauses 1-10, wherein the one or more secondary seals are integrally formed with the container.

Clause 12. A method of forming a child-resistant reclosable bag, the method comprising:
- providing one or more primary seals on a zipper;
- providing one or more secondary seals at one or more defined locations on the zipper, wherein the one or more secondary seals at the one or more defined locations provide one or more areas to be engaged to peel open a container; and
- coupling the zipper to the container configured to retain one or more items.

Clause 13. The method of Clause 12, wherein the one or more primary seals extend along an entire width of the container, and wherein the one or more secondary seals extend along less than the entire width of the container.

Clause 14. The method of Clauses 12 or 13, wherein the one or more secondary seals are proximate to a side of the bag.

Clause 15. The method of any of Clauses 12-14, wherein the one or more secondary seals are between 5-10% of a length of the one or more primary seals.

Clause 16. The method of any of Clauses 12-15, wherein the one or more secondary seals are at a height that is the same or greater than a height of locking elements of the zipper.

Clause 17. The method of any of Clauses 12-16, further comprising identifying the one or more secondary seals with one or more of color-coding, text, or a tactile feature.

Clause 18. The method of any of Clauses 12-17, further comprising providing indicia for instructions for opening on the container.

Clause 19. The method of any of Clauses 12-18, further comprising integrally forming the one or more secondary seals with the container.

Clause 20. A child-resistant reclosable bag, comprising:
- a container configured to retain one or more items; and
- a zipper coupled to the container, wherein the zipper comprises:
  - one or more primary seals, wherein the one or more primary seals extend along an entire width of the container; and
  - one or more secondary seals at one or more defined locations, wherein the one or more secondary seals extend along less than the entire width of the container, wherein the one or more secondary seals are proximate to a side of the bag, wherein the one or more secondary seals are between 5-10% of a length of the one or more primary seals, wherein the one or more secondary seals are at a height that is the same or greater than a height of locking elements of the zipper, and wherein the one or more secondary seals at the one or more defined locations provide one or more areas to be engaged to peel open the container.

As described herein, embodiments of the present disclosure provide a child-resistant bag that does not require graspable tabs for opening. Further, the secondary seal can be incorporated during bag fabrication, thereby allowing registration with the bag, in contrast to a random location of tabs.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A child-resistant reclosable bag, comprising:
- opposing first and second walls configured to retain one or more items between the first and second walls; and
- a zipper coupled to the first and second walls, wherein the zipper comprises:
  - opposed first and second locking elements configured to be selectively engaged to close the child-resistant reclosable bag, and disengaged to open the child-resistant reclosable bag;
  - a second primary seal coupling the zipper to the first wall below the first locking element;
  - a first primary seal coupling the zipper to the second wall above the second locking element; and
  - a secondary seal that is separate and distinct from the second primary seal, the secondary seal coupling the zipper to the first wall at or above the first locking element and offset from a first side of the first and second walls, the secondary seal not extending to a second side of the first and second walls that is opposite the first side, the zipper coupled to the first wall by only the second primary seal and the secondary seal, the zipper coupled to the second wall by only the first primary seal, and wherein the secondary seal provides one or more areas to be engaged to open the child-resistant reclosable bag.

2. The child-resistant reclosable bag of claim 1, wherein the zipper further comprises:
- a first flange coupled to the first wall by the second primary seal and the secondary seal, the first flange including the first locking element; and
- a second flange coupled to the second wall by the first primary seal, the second flange including the second locking element,
- wherein the second primary seal is located between the first flange and the first wall below the first locking element, the secondary seal is located between the first flange and the first wall at or above the first locking element, and the first primary seal is located between the second flange and the second wall above the second locking element.

3. The child-resistant reclosable bag of claim 1, wherein the second primary seal extends along an entire width of the first and second walls below the first locking element, the first primary seal extends along the entire width of the first and second walls above the second interlocking element with no other seal between the second wall and the zipper below the first primary seal, and the secondary seal extends along less than the entire width of the first and second walls at or above the first locking element.

4. The child-resistant reclosable bag of claim 1, wherein the secondary seal is associated with a tactile feature.

5. The child-resistant reclosable bag of claim 1, wherein the child-resistant reclosable bag is devoid of cut zipper tabs.

6. The child-resistant reclosable bag of claim 1, wherein the secondary seal is integrally formed with the first wall.

7. The child-resistant reclosable bag of claim 1, wherein each of the second primary seal and the secondary seal couples the zipper to the first wall but not the second wall, and the first primary seal couples the zipper to the second wall but not the first wall.

8. The child-resistant reclosable bag of claim 1, wherein the first primary seal and the second primary seal extend across an entire width of the child-resistant reclosable bag from the first side of the first and second walls to the second side of the first and second walls, the secondary seal includes first and second secondary seals spaced apart from each other with each of the first and second secondary seals extending over a portion and less than the entire width of the child-resistant reclosable bag.

9. The child-resistant reclosable bag of claim 1, wherein the child-resistant reclosable bag is forced into a shear mode while upper ends of the first and second walls are pulled apart from each other in a first portion of a width of the first and second walls that does not include the secondary seal, and the child-resistant reclosable bag is forced into a peel mode while upper ends of the first and second walls are pulled apart from each other in a second portion of a width of the first and second walls that includes the secondary seal.

10. The child-resistant reclosable bag of claim 1, wherein the zipper is coupled to the second wall by only the first primary seal across an entire width of the zipper along the first wall.

11. A method of forming a child-resistant reclosable bag, the method comprising:

attaching a zipper to a first wall of the child-resistant reclosable bag with a second primary seal, the zipper having opposed first and second locking elements configured to be selectively engaged to close the child-resistant reclosable bag, and disengaged to open the child-resistant reclosable bag, the zipper attached to the first wall with the second primary seal located below the first locking element;

attaching the zipper to a second wall of the child-resistant reclosable bag with a first primary seal above the second locking element; and attaching the zipper to the first wall with a secondary seal that is separate and distinct from the second primary seal and in a location that is at or above the first locking element, the secondary seal offset from a first side of the child-resistant reclosable bag, the secondary seal not extending to a second side of the child-resistant reclosable bag that is opposite from the first side, the zipper attached to the first wall by only the second primary seal and the secondary seal, the zipper coupled to the second wall by only the first primary seal, wherein the secondary seal provides one or more areas to be engaged to peel open the child-resistant reclosable bag.

12. The method of claim 11, wherein the zipper is attached to the first wall with the second primary seal extending along an entire width of the child-resistant reclosable bag from the first side to the second side, the zipper is attached to the second wall with the first primary seal extending along the entire width of the child-resistant reclosable bag, and the zipper is attached to the first wall with the secondary seal extending along less than the entire width of the child-resistant reclosable bag.

13. The method of claim 11, wherein the zipper is attached to the first wall with the second primary seal located below the first locking element and with the secondary seal at or above the first locking element, and the zipper is attached to the second wall with the first primary seal located above the second locking element.

14. The method of claim 11, further comprising providing the secondary seal with a tactile feature.

15. The method of claim 11, further comprising providing indicia for instructions for opening on the child-resistant reclosable bag.

16. The method of claim 11, further comprising integrally forming the secondary seal with the child-resistant reclosable bag.

17. The method of claim 11, wherein the zipper is attached to the first wall by only the second primary seal and the secondary seal, and the zipper is attached to the second wall by only the first primary seal.

18. A child-resistant reclosable bag, comprising:

opposing first and second walls configured to retain one or more items between the first and second walls;

a zipper coupled to the first and second walls, the zipper including:

opposed first and second locking elements configured to be selectively engaged to close the child-resistant reclosable bag, and disengaged to open the child-resistant reclosable bag, the first locking element coupled with the first wall, the second locking element coupled with the second wall;

a second primary seal extending along an entire width of the first wall below the first locking element;

a secondary seal extending a portion and less than the entire width of the first wall at or above the first locking element, the secondary seal being separate and distinct from the second primary seal, the second primary seal and the secondary seal coupling the zipper to the first wall; and a first primary seal extending along the entire width of the second wall at or above the second locking element, the first primary seal coupling the zipper to the second wall, the zipper coupled to the first wall by only the second primary seal and the secondary seal, the zipper coupled to the second wall by only the first primary seal.

19. The child-resistant reclosable bag of claim 18, wherein the zipper includes a first flange and a second flange, the first locking element protruding from the first flange, the second locking element protruding from the second flange, the first flange coupled with the first wall by the second primary seal and the secondary seal, the second flange coupled with the second wall by the first primary seal.

20. The child-resistant reclosable bag of claim 18, wherein the second primary seal and the secondary seal are spaced apart from each other and do not contact each other.

21. The child-resistant reclosable bag of claim 18, wherein each of the second primary seal and the secondary seal couples the zipper to the first wall but not the second wall, and the first primary seal couples the zipper to the second wall but not the first wall.

* * * * *